United States Patent [19]

Bernwall et al.

[11] 4,274,606

[45] Jun. 23, 1981

[54] SELF-TAILING WINCH

[76] Inventors: Hans Bernwall, 133 Granada Dr., Corte Madera, Calif. 94925; Lars Lundberg, Box 28, 45071 Fjällbacka, Sweden; Carl Seipel, 44 Laurel Grove Ave., Kentfield, Calif. 94904

[21] Appl. No.: 71,268

[22] Filed: Aug. 30, 1979

[51] Int. Cl.[3] ..... B65H 75/18

[52] U.S. Cl. ..... 242/117; 242/118; 242/3

[58] Field of Search ..... 242/117, 118.3, 128; 254/150 R, 187.2, DIG. 13, DIG. 14

[56] References Cited

U.S. PATENT DOCUMENTS

| | | | |
|---|---|---|---|
| 1,209,179 | 12/1916 | Lipps | 242/128 |
| 3,730,483 | 5/1973 | Newell | 254/150 |
| 3,876,165 | 4/1975 | Comer | 242/125.1 |

FOREIGN PATENT DOCUMENTS

| | | | |
|---|---|---|---|
| 1185478 | 3/1970 | United Kingdom | 242/117 |

*Primary Examiner*—Leonard D. Christian

*Attorney, Agent, or Firm*—Limbach, Limbach & Sutton

[57] ABSTRACT

An improved winch is disclosed which possesses means for increasing the coefficient of friction on the surface of the spool only in an area substantially at the intersection of the drum and flange sections of the winch so that only the last turn of rope or line around the winch would contact the area of increased friction. Friction in this area can be increased by placing a rubber ring over a conventional winch which makes it self-tailing. As a further embodiment, the winch possesses a surface which is recessed, said recess containing radial projection elements for the support of friction increasing sections contained between said radial projection elements within the recess.

13 Claims, 6 Drawing Figures

SELF-TAILING WINCH

BACKGROUND OF THE INVENTION

Figure 1:
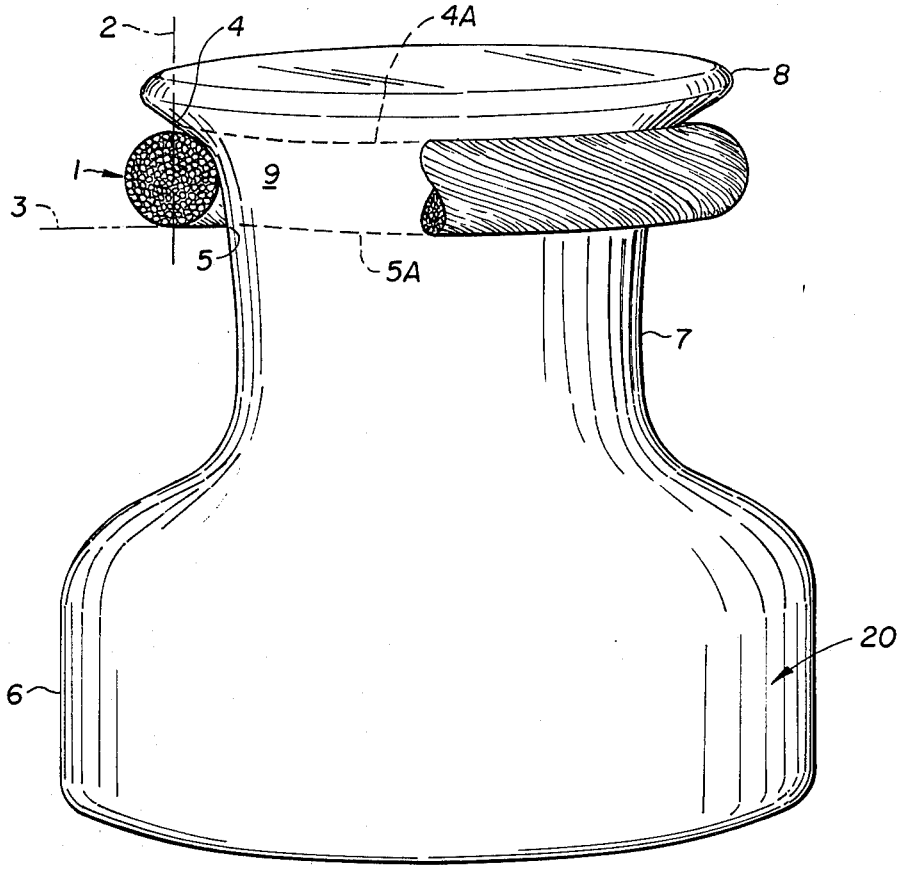

Sailboat winches are used for the tensioning or easing of sheet or halyard lines under considerable load forces from sails attached to the line or rope. The basic winch consists of a center support with ratchets, gears, and an attachment to support a removable cranking handle to rotate a spool about the center support. The spool consists of a base, drum and flange wherein the drum is configured to be narrower than the base and flange and is capable of accepting multiple turns of rope or line for its retrieval. The base, having a much wider diameter than the drum, curves into the drum sharply. The drum is in turn slightly conical being narrower at the base end than the flange end. This configuration aids in keeping the turns of rope on the drum from interlocking and fouling. The ratchet mechanism keeps the spool from rotating in more than one direction which, of course, is a necessary characteristic of any winch which is intended to retrieve line under tension.

In operating a winch upon a sailboat, line is wrapped around the spool in the direction in which the spool can be cranked and the line or rope is wrapped about the drum area between the base and flange a multiple number of turns depending upon the intensity of the load presented by the sail attached to the load end of the line or rope. Once these multiple turns are made, the sail can be controlled by cranking the handle which provides sufficient leverage to increase or diminish tension upon the sail through the load end of the line or rope. The free end of rope is called the tail and tension can be eased upon the sail by removing tension from the tail end and letting the turns of rope slip around the drum. The winch, itself, is incapable of turning to release tension because of the ratchet mechanism recited above.

From the above discussion, it is quite evident that a certain degree of tension must be kept on the tail end of the line to keep it in position or to bring more line in by cranking. The more turns about the drum, the less tension is necessary on the tail end to keep the turns from slipping although some tension must be kept on the tail end of a line under load to keep it from unraveling from the drum. The maintaining of tension on the tail end of a line under load which is tensioned by cranking is called "tailing" the line. The tailing operation is best carried out by someone other than the operator who is cranking the winch handle for it is awkward and slow for a single person to perform both functions noting that it often takes both hands to crank the winch when the load is great. Also, the operator, if attempting to perform both functions, must stop cranking to shift his grip on the tail end of the line when he approaches the end of his reach. Furthermore, it is quite difficult to keep one's balance on a pitching and rolling sailboat when both hands are occupied in different tasks.

Recognizing the problems recited above, there exists devices known as mechanical "self-tailing" winches. Such devices usually have a shorter drum and thicker flange than standard winches and have a V-shaped groove configured within the flange giving the flange the appearance of a fan belt pulley. The width of the V-shaped groove is designed to accomodate the thickest lines to be used on the particular winch and the groove is ridged to aid in gripping the rope or line.

When the tail end is wrapped into the V-shaped groove of the mechanical self-tailing winch and tension is applied from the load end, the tail end of the line is held quite strongly by the groove and cams. As tension is increased upon the line, the line slips deeper within the groove and gripping increases. These winches are further equipped with a fairleading mechanism designed to feed the line from the drum into the groove at a predetermined point and to direct the line out of the groove at a second point before the tail end completes a full 360° turn. The fairleads are superimposed upon the flange and are attached to the center support section of the winch and remain in a specific fixed position when the spool is rotated.

Although mechanical self-tailing winches perform adequately, they cost considerably more than nonself-tailing winches. Furthermore, it has been found that the fairleads atop the winch tend to foul lines when they have to be released quickly. Depending upon their particular construction, many fairleads demonstrate the tendency to catch and tear clothes and sails and present a potential danger to the operator of the mechanical self-tailing winch.

Realizing the disadvantages inherent in the mechanical self-tailing winch, another product which has recently appeared is called the "WINCHER", marketed by Watski of Scandinavia. The "WINCHER" is a molded rubber cap, designed to fit tightly over the flange of a standard winch. The rubber cap looks much like the V-grooved flange which is possessed by the mechanical self-tailing winches described previously while the bottom of the cap possesses an opening so that it might fit upon the spool of an existing non-self-tailing winch. Naturally, the top of the cap has a smaller hole allowing the winch handle to pass therethrough. The groove and lower edge of the cap just cover the uppermost part of the drum nearest the flange and the upper edge is intended to fit tightly over the flange.

When using the "WINCHER", an operator must first bring in the line by hand until the load becomes sufficiently intense to require the use of the crank. At this point, the operator would wrap the line in additional turns around the drum of the winch until the final turn is pressing against the rubber at the bottom part of the cap. The V-shaped groove is used only for permanently cleating the tail end of the line and serves no function in making the winch self-tailing. The underside of the rubber cap applies enough pressure and friction against the final turn to hold this turn and consequently, the previous turns in place. When the winch is cranked to bring in additional line, the pressure is increased on the final turn of the line against the rubber cap. The winch becomes self-tailing as the tail end is forced off the winch by the added line at the base of the spool while the snubbing pressure at the cap keeps the turns from slipping.

Although the "WINCHER" represents a distinct advantage over the prior art by allowing for the conversion of existing non-self-tailing to self-tailing winches at a considerably lower cost than would be required to purchase new mechanical self-tailing devices, the "WINCHER" does, nevertheless, have its own disadvantages. Foremost among these disadvantages is that the "WINCHER" does not provide a means of directing the tail end of the line off the spool at a designated spot. The springlike pressure from the disc-shaped rubber underside of the cap is effective in preventing the turns from slipping but the same cleating effect has a tendency to prevent the tail end from peeling off the winch at the same rate as more line is cranked onto the spool. By acting as a spring, the cap can allow more turns on the drum which further increases the pressure upon the cap. The end result of all of this is a tendency for the tail end of the line to be rotated into the loaded end of the line entering into the spool, thereby fouling and locking the turns.

A further disadvantage inherent in the "WINCHER" is that because of its relatively stiff heavy rubber construction, the device must be configured rather closely to a specific size winch. Thus, a relatively large number of shapes and sizes must be configured to fit the wide variety of winches having diverse shapes and dimensions in their drum/flange configuration. Currently, there are three sizes of the "WINCHER" offered which provide a relatively poor fit on many winches currently used and, resultingly, the "WINCHER" must be bonded to the spool to insure that no slippage occurs.

SUMMARY OF THE PRESENT INVENTION

It is an object of the present invention to provide a self-tailing winch without any of the disadvantages described above.

It is yet another object of the present invention to provide a self-tailing winch which is less costly than currently available mechanical self-tailing winches.

It is still another object of the present invention to provide a self-tailing winch without the need for fairleading mechanisms.

It is still another object of the present invention to provide a self-tailing winch in which there is virtually no risk of fouling the tail end of the line.

It is yet another object of the present invention to provide a self-tailing winch wherein virtually any currently existing winch can be converted simply and effectively to perform in a self-tailing manner.

Figure 2A:
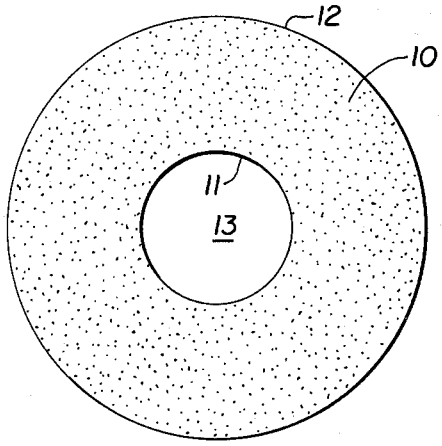
Figure 2B:
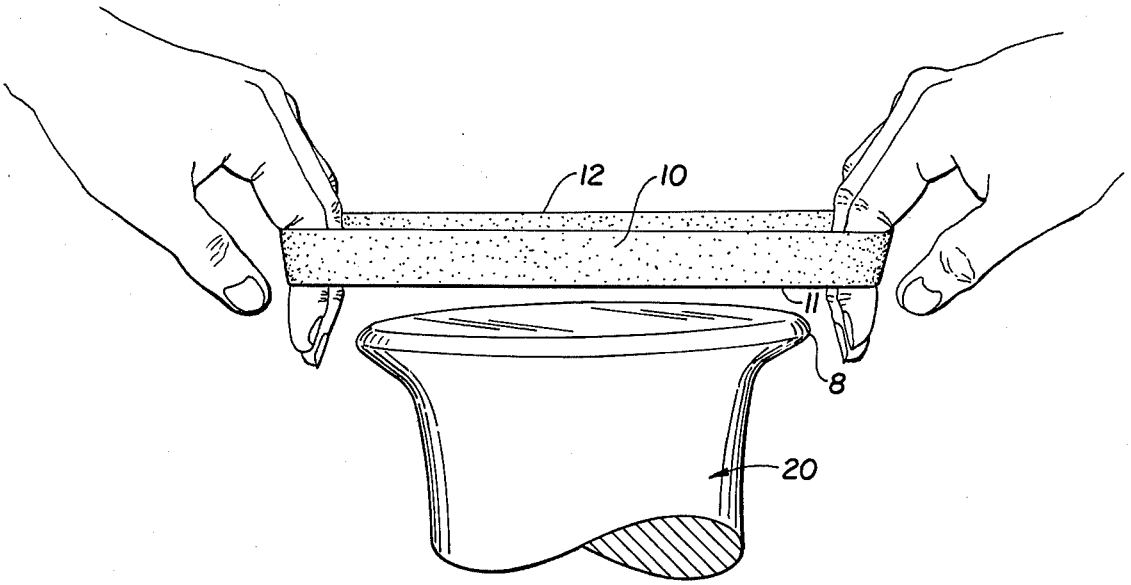
Figure 2C:
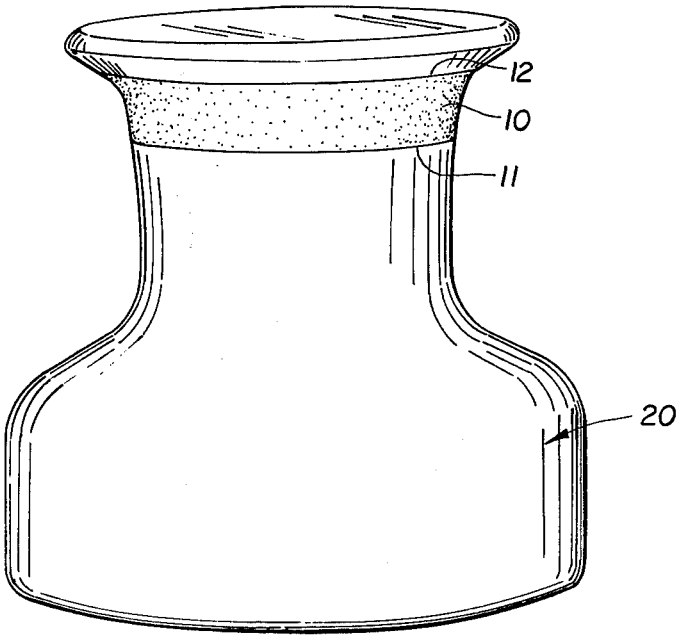
Figure 3:
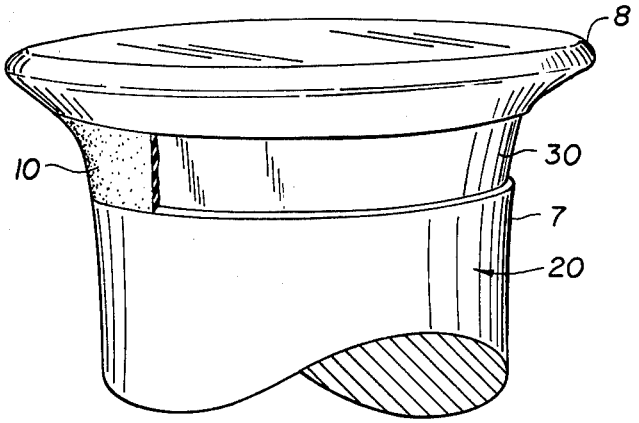
Figure 4:
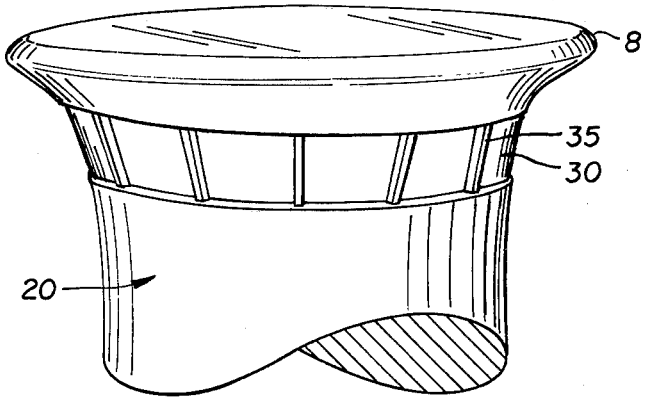

These and other objects of the present invention will be more fully appreciated when considering the appended drawings wherein FIG. 1 is a side perspective view of a standard winch spool showing the placement of the last turn of rope around the spool in cross section; and FIG. 2*a* is a top view of a rubber ring used to convert a standard non-self-tailing winch into the self-tailing winch of the present invention; and FIG. 2*b* is a view which shows the placement of the rubber ring of 2*a* onto the winch spool; and FIG. 2*c* is a side view of a winch spool having located thereon, the rubber ring of FIG. 2*a;* and FIG. 3 is a partial side view of a winch spool having a recessed annular section for acceptance of the ring shown in FIG. 2*a;* and FIG. 4 is a partial side view of the winch spool of FIG. 3 having radial projections placed within the recessed annular area.

The standard winch possesses a spool which has a base, drum and flange wherein the drum is configured to be narrower than the base and flange and is capable of accepting multiple turns of line or rope for retrieving the same. The present invention deals with an improvement to the standard winch which comprises means for increasing the coefficient of friction on the surface of the spool only in an area substantially at the intersection of the drum and flange wherein only the last turn of rope which is possible to lay around the winch would contact the area of increased friction. This can best be visualized by viewing FIG. 1 wherein spool 20 represents the spool of a standard nontailing winch which is currently being used by the vast majority of sailboat owners. The tensioned end of the line which is connected to the sail enters the spool at a point just above base 6 onto drum 7 and is wrapped around from 7 until a point just below flange 8. A cross section of the last turn of rope is shown by cross section 1 at a point where the transition occurs between drum 7 and flange 8. It is at that point, and that point only, where the friction increasing means is applied to the spool to convert an ordinary winch into one having self-tailing characteristics.

Referring again to FIG. 1, the area of increased coefficient of friction extends substantially no higher than a point upon the flange established by a vertical line which intersects the flange through the center of the last turn of line or rope upon the drum. As shown in FIG. 1, center line 2 is drawn vertically intersecting flange 8 at point 4. This establishes the uppermost boundary of the friction increasing area shown by dotted line 4*a*.

Similarly, the lowermost boundary of the friction increasing area is established by a horizontal line which intersects the drum from a tangent drawn from the lowermost extremity of last turn of rope 1. In FIG. 1, horizontal tangent 3 intersects drum 7 at point 5 which establishes lower boundary 5*a*.

With the above discussion in mind, the present invention operates in the following manner. The tension from the load end of the line has the effect of making each turn tighten around the drum. When the final turn tightens over the area of increased friction, it is prevented by the tightening and by the friction from slipping. Thus, the previous turns are also held in place. When the winch is cranked to bring in more of the line or rope under load, the effect of the area of increased friction 9 under the final turn becomes that of tailing the line. At about the point where the loaded end comes on to the winch, the tail end is pushed or peeled off the winch at the same rate that the line is being winched in. This effect is produced by flange 8 at the top part of drum 7 noting that physically, the turns of line are stacked upon the drum in a diagonal reminding one of the coils of a spring. At the point where the loaded end of the line comes onto the drum, the drum's maximum capacity for holding turns of line is surpassed at the flange and the final turn gets pushed off the winch by pressure generated from the previous turns and by the curve of flange 8. Thus, the diagonal slacking of the turns and the shape of the flange combine to produce a fairleading effect and the end result of affixing a surface of increased friction in designated area 9 is that of creating a self-tailing effect.

It should be noted that the area of increased friction 9 need not be as wide as that area embraced by dotted lines 4*a*/5*a*. These lines of demarcation represent the approximate maximum area of increased friction. If area 9 extends beyond dotted line 4*a* to a point higher on flange 8, it would prevent optimum "peeling off" of the line and would exhibit one of the disadvantages inherent in the "WINCHER" of the prior art. Similarly, if the area of increased friction were to extend below dotted line 5*a*, one or more turns before the final turn would be snubbed upon the drum which would remove tension from the final turn. This would result in a failure of the final turn to grip the spool and the final turn would merely fall off the spool in an unpredictable manner which would, in turn, tend to foul the line in at least one point along the spool.

Virtually any means can be used to increase the coefficient of friction in area 9 and remain within the scope of the present invention. As a preferred embodiment, merely for its simplicity in converting existing non-self-tailing winches to those having a self-tailing effect is the use of a rubber ring as shown in FIG. *2a*. The specific rubber to be used is not critical as long as it possesses relatively high anti-skid properties. It was found that EPDM (ethylene propylene diene monomer) rubber not only possesses sufficiently high anti-skid properties, but is sufficiently elastic to be stretched three to four times its length without significant deformation, could maintain its static tension when stretched and is fairly impervious to external elements such as sun, weather and ozone. As noted previously, a rubber ring represents the preferred embodiment of the present invention only because of its relatively low cost and ease of production although virtually any material possessing sufficient anti-skid or frictional properties can be applied to area 9 and remain within the scope of the present invention.

Turning to FIG. *2a*, annular rubber ring 10 can be cut from a flat sheet of rubber of approximately 1/16 inch thickness. The sheet is cut so that center hole 13 has a diameter of approximately 40%–60% that of the drum of the winch for which it is intended. The width of the ring from inner edge 11 to outer edge 12 is determined by the size of area 9 described with reference to FIG. 1 although it is generally noted that most applications require a width of from approximately 1⅛ to 1¼ inches to give a satisfactory fit on most winches having a drum diameter up to approximately 4 inches.

As shown in FIG. *2b*, rubber ring 10 can be applied to winch spool 20 merely by stretching said rubber ring over flange 8 into a final position shown in FIG. *2c*. It should be noted that inner edge 11 of center hole 13 becomes the lower edge of the friction increasing member once placed upon the winch spool. Choosing a diameter for hole 13 approximately 50% of the diameter of the drum insures that all sections of ring 10 are stretched when in position on the winch spool thereby gripping the winch tightly without bonding. Furthermore, this configuration provides for slightly more stretching at inner circumference 11 than at outer circumference 12 which results in a slightly thinner edge at 11 providing for a smooth transition between the metallic winch spool and the friction increasing strip.

Up to this point, it should be quite evident that the invention has been described as a means for adapting currently existing non-self-tailing winches to exhibit a self-tailing effect. However, the invention is broad enough to further embrace a completely modified winch spool structure. In this regard, reference is made to FIG. 3 wherein area 9 shown in FIG. 1 as the area possessing an increased coefficient of friction is now recessed as area 30. In this way, a rubber ring 10 or similar friction increasing material can be fitted within area 30 to present a completely smooth transition between drum 7 and flange 8. Now, thicker rubbers can be used without concern about the line or rope making a smooth transition between the low friction metal drum and the high friction surface. By using thicker materials, a more durable long-lasting product can be produced.

A further improvement upon that embodiment shown in FIG. 3 is that shown in FIG. 4 wherein radial projection elements 35 are inserted within recess 30. Individual rubber or other high coefficient of friction materials can be actually molded in place between adjacent radial projection members to prevent these materials from rotating.

The present invention has been described in terms of a continuous high friction material placed approximately at the intersection of the drum and upper flange. However, one could remain within the present invention by providing a noncontinuous high friction material at this transition area as long as enough of the spool were covered to produce the desired self-tailing effect.

We claim:

1. In a winch for the retrieval of rope on a sailboat having a spool rotatable about the axis of the winch wherein said spool has a base, drum and flange and wherein said drum is configured to be narrower than said base and flange and is capable of accepting multiple turns of said rope for rectrieval, the improvement comprising means for increasing the coefficient of friction on the surface of said spool only in an area substantially at the intersection of said drum and flange wherein only the last turn of said rope around the winch would contact the area of increased friction.

2. The winch of claim 1 wherein said means for increasing the coefficient of friction comprises a rubber ring.

3. The winch of claim 2 wherein said rubber ring is continuous about the circumference of the spool.

4. The winch of claim 2 wherein said rubber ring is adhesively attached to the spool.

5. The winch of claim 2 wherein said rubber ring is approximately 1/16 inches thick.

6. The winch of claim 2 wherein said rubber ring is composed of rubber which is capable of stretching three to four times its length without substantial deformation.

7. The winch of claim 1 wherein said means for increasing the coefficient of friction is thinner in the area where it contacts the drum as compared to the area where it contacts the flange.

8. The winch of claim 1 wherein said means for increasing the coefficient of friction on the surface of the spool has a width between approximately ⅛ to ¼ inches.

9. The winch of claim 1 wherein said means for increasing the coefficient of friction extends no higher upon the flange than a point established by a vertical line which intersects the flange through the center of the last turn of rope upon the drum and extends substantially no lower upon the drum than a point established by a horizontal line which intersects the drum from a tangent at the lowermost extremity of the last turn of rope.

10. The winch of claim 2 wherein the rubber ring is composed of EPDM rubber.

11. The winch of claim 1 wherein the surface of said spool is recessed in the area of increased friction an amount substantially equal to the thickness and width of said means for increasing the coefficient of friction.

12. The winch of claim 2 wherein the inner diameter of the rubber ring is approximately 50% of the diameter of the drum.

13. The winch of claim 11 wherein said recess contains radial projection elements for the support of friction increasing sections contained between said radial projection elements within said recess.

* * * * *